US005724876A

United States Patent [19]

Johnson

[11] Patent Number: 5,724,876

[45] Date of Patent: Mar. 10, 1998

[54] PORTABLE CAM-LINK LOG CUTTING APPARATUS

[75] Inventor: Calvin S. Johnson, Union Grove, N.C.

[73] Assignee: CTR Manufacturing, Inc., Union Grove, N.C.

[21] Appl. No.: 556,173

[22] Filed: Nov. 9, 1995

[51] Int. Cl.[6] ..... B27B 17/08

[52] U.S. Cl. ..... 83/602; 83/609; 83/639.5; 83/639.7; 83/928; 144/34.1

[58] Field of Search ..... 83/602, 639.5, 83/607, 796, 800, 928, 574, 639.7, 608, 609; 144/34.1

[56] References Cited

U.S. PATENT DOCUMENTS

| | | | |
|---|---|---|---|
| 3,604,479 | 9/1971 | Jordan | 83/928 |
| 3,726,326 | 4/1973 | Coleman | 144/34.1 |
| 3,779,115 | 12/1973 | Talbert . | |
| 3,796,242 | 3/1974 | Albright | 83/928 |
| 3,967,698 | 7/1976 | Smith et al. . | |
| 3,976,111 | 8/1976 | Jonsson . | |
| 4,016,956 | 4/1977 | Karlsson . | |
| 4,030,387 | 6/1977 | Finnimore . | |
| 4,094,382 | 6/1978 | Lee . | |
| 4,116,250 | 9/1978 | Ericsson . | |
| 4,123,957 | 11/1978 | Niemela et al. | 83/796 |
| 4,132,289 | 1/1979 | Mäkelä . | |
| 4,221,245 | 9/1980 | Wildey | 144/34.1 |
| 4,230,010 | 10/1980 | Guenthner . | |
| 4,281,693 | 8/1981 | Moulson | 83/928 |
| 4,530,266 | 7/1985 | Hedberg | 83/796 |
| 4,722,258 | 2/1988 | Johnson | 83/796 |
| 4,763,705 | 8/1988 | Johnson . | |
| 5,058,470 | 10/1991 | Fröhlich . | |
| 5,103,881 | 4/1992 | Johnson . | |
| 5,163,489 | 11/1992 | Ketonen . | |
| 5,322,103 | 6/1994 | Hudson . | |

FOREIGN PATENT DOCUMENTS

| | | | |
|---|---|---|---|
| 869685 | 10/1981 | U.S.S.R. | 144/34.1 |

*Primary Examiner*—Maurina T. Rachuba

*Attorney, Agent, or Firm*—Kennedy Covington Lobdell & Hickman, LLP

[57] ABSTRACT

A log cutting apparatus having a support frame, a cutting arm, and first and second hydraulic cylinders for pivotally actuating the cutting arm through a cutting arc. The support frame comprises two support members and a removable linking member for easy disassembly and transport of the log cutting apparatus. The support frame includes a cutting arm housing for protecting the cutting arm in a laid back position with the cutting side of the cutting arm disposed upwardly. The cutting arm passes through a vertical during the cutting stroke. The first hydraulic cylinder works in conjunction with a cam-link, actuating the cutting arm from a retracted position within the housing to an intermediate position through rotation of the cam-link. The second hydraulic cylinder actuates the cutting arm from the intermediate position to an extended position during which the actual log cutting is performed. Furthermore, cam-link disengages from the cutting arm after actuating the cutting arm from the retracted position, and it acts as both a hydraulic retarder upon return of the cutting arm from the cutting stroke to the retracted position and as a shock absorber when the cutting arm reaches the retracted position.

19 Claims, 9 Drawing Sheets

PORTABLE CAM-LINK LOG CUTTING APPARATUS

BACKGROUND OF THE PRESENT INVENTION

The present invention relates to the tree harvesting art and, more particularly, to an improved log cutting apparatus for felled trees that is easily disassembled and transported.

For centuries, trees have been commercially harvested on a mass scale for processing of their wood into all forms of timber, lumber, paper and other derivative products. Historically, the initial operation of felling trees at the harvesting site has been carried out manually. Due to the demand for wood, however, many machines have been designed for felling trees. Once felled, the trees are delimbed and typically cut to a similar length. One conventional form of apparatus for the automated cutting of the felled trees to a uniform length is commonly known as a "slasher" and basically comprises a log support frame with a hydraulically operated chain saw or other appropriate cutting means movably disposed at one end of the frame to sever logs to length when placed thereon. Typically, a knuckle boom loader is utilized to pick-up felled trees and place them onto the slasher frame to be cut to a uniform length

SUMMARY OF THE PRESENT INVENTION

The present invention provides an improved slasher-type log cutting apparatus basically having a support frame defining a log cutting area for supporting therein a log to be cut, an elongated log cutting arm pivotably mounted to the frame adjacent the log cutting area for pivotal log cutting movement between a retracted position and an extended position, and hydraulic means for actuating pivotal movement of the log cutting arm from the retracted position to the extended position. During the log cutting stroke, the cutting arm moves from the retracted position to the extended position with the cutting side of the arm passing substantially fully through the cutting area. The hydraulic means which drives the cutting arm through its cutting stroke extends between the frame and the cutting arm.

In one feature of the present invention, the support frame comprises a first frame member that defines the log cutting area, a second frame member to be spaced at a distance from the first frame member for supporting a log to be cut, and an elongated linking frame member interconnecting the first and second frame members. The linking frame member releasably attaches to the first and second frame members, thereby providing for easy disassembly and transport of the log cutting apparatus in three pieces.

In another feature of the present invention, the log cutting arm, when in the retracted position, is disposed in a reclining "laid back" position extending outwardly away from the log cutting area within a protective housing of the support frame, whereby the cutting side of the cutting arm is disposed upwardly when the cutting arm is in the retracted position. When a cutting stroke is initiated, the cutting arm passes through a vertical in rotating from the retracted position to the extended position.

In another feature of the present invention, the hydraulic means comprises a first hydraulic means and a second hydraulic means extending between the cutting arm and the support frame for actuating pivotal movement of the cutting arm. The first hydraulic means acts to position the cutting arm from the retracted position to an intermediate position to prepare the cutting arm for the beginning of actual log cutting. The second hydraulic means actuates pivotal movement of the cutting arm from the intermediate position to the extended position thereby driving the cutting arm through the actual cutting arc of the cutting stroke.

Preferably, the first hydraulic means of the present invention includes a first hydraulic cylinder and a cam-link. The first hydraulic cylinder is pivotally attached to the support frame at one end thereof and is pivotally attached to the cam-link at the other end thereof. The cam-link is pivotally attached to the frame member and engages the cutting arm when the cutting arm is in the retracted position. The cam-link urges the cutting arm out of the retracted position towards the intermediate position when the first hydraulic cylinder rotates the cam-link. Furthermore, the second hydraulic means preferably comprises a second hydraulic cylinder pivotally mounted to the cutting arm at one end and to the support frame at the other end.

It is also preferred that the cam-link disengages from the cutting arm when the cutting arm pivots past the intermediate position to rotate towards the extended position and that the cam-link re-engages the cutting arm when the cutting arm rotates back towards the retracted position. The cam-link and first hydraulic cylinder thereby become a hydraulic retarder slowing the rotation of the cutting arm and acting as a shock absorber when the cutting arm is returned to the retracted position.

The advantages of the present invention are numerous. The uniform cutting of trees may be accomplished in relatively short time due to the use of a knuckle boom loader in conjunction with the log cutting apparatus of the present invention. The laid back reclined positioning of the cutting arm when retracted in the support frame allows a greater swing work throat area when hauling felled trees or logs onto the log cutting apparatus of the present invention.

Furthermore, the use of dual hydraulic means allows maximum cutting torque when the cutting arm extends through the midpoint of its actual cutting arc. The use of dual hydraulic means further allows a greater cumulative cutting arm arc since the cutting arm, when in the retracted position, is substantially parallel to the second hydraulic cylinder; whereas the second hydraulic cylinder would be ineffective in positioning the cutting arm from the retracted position to the intermediate position in such a case, since the force applied to the cutting arm would result in a radial force and no substantial tangential force with respect to the pivot point of the cutting arm, the first hydraulic means can be positioned to act in substantially a tangential direction, thereby creating the torque necessary to pivot the cutting arm out of the retracted position and into the intermediate position. This also subsequently allows the first hydraulic means to act as a hydraulic retarder and shock absorber for the cutting arm when finishing a log cutting stroke and returning to the retracted position; the return of the cutting arm compresses the first hydraulic cylinder, thereby slowing the cutting arm's return angular velocity. Compression of the second hydraulic cylinder at this point is marginal.

Since the linking frame member of the support frame is releasably detachable from the first and second frame members, a further advantage of the present invention is that the linking member may be removed and the log cutting apparatus thereby disassembled into three pieces for transport. This allows greater versatility and ease of movement in transporting the log cutting apparatus from harvesting cite to harvesting cite, as opposed to transporting an assembled log cutting apparatus, in which case the full length of the log cutting apparatus must be accommodated.

DESCRIPTION OF THE PREFERRED EMBODIMENT

Figure 1:
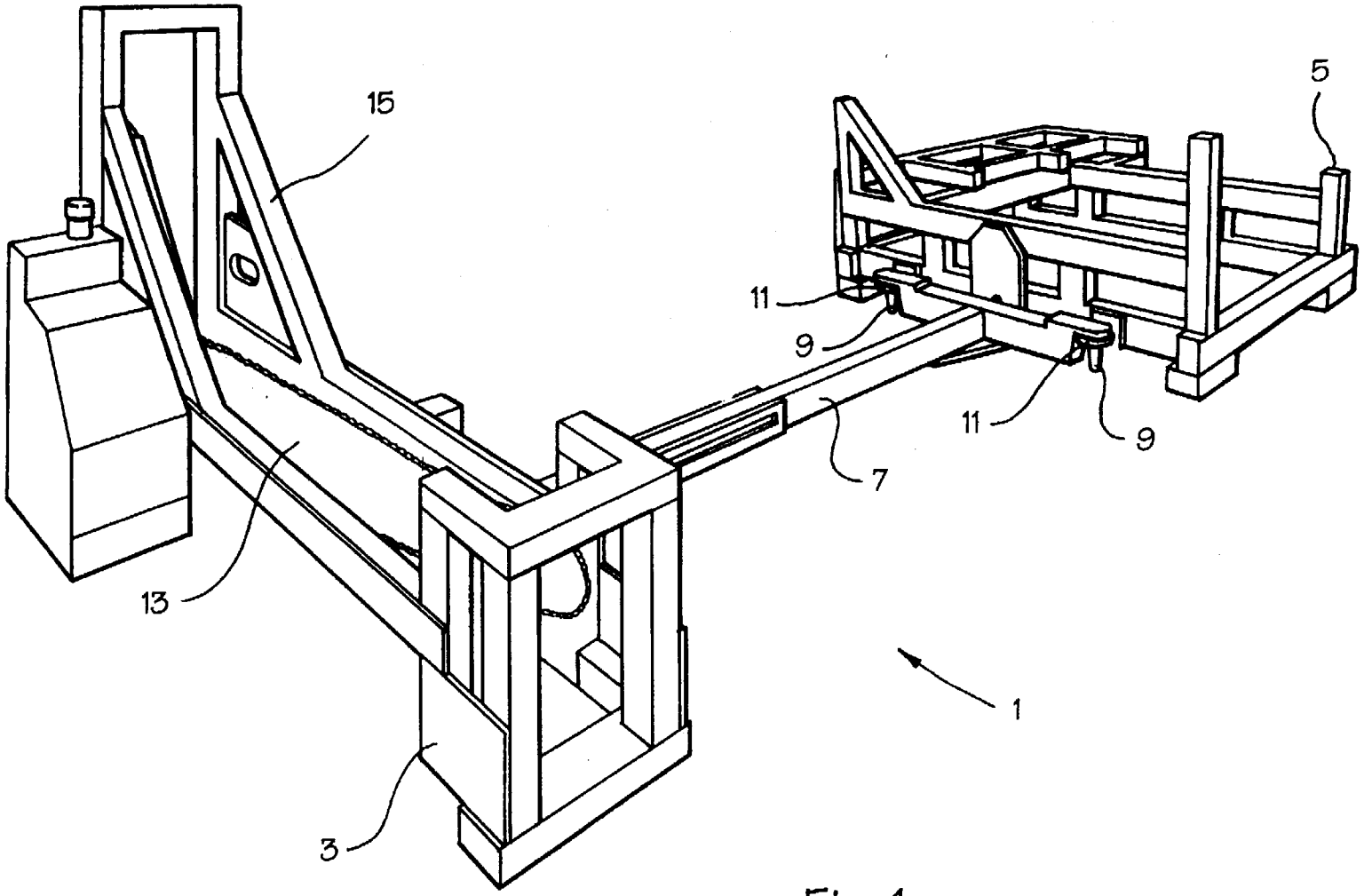
FIG. 1 is a perspective view of the preferred log cutting apparatus of the present invention.

As shown in the drawings and more fully explained below, the preferred embodiment of the log cutting apparatus 1 of the present invention includes a first frame member 3 and a second frame member 5 interconnected by a linking frame member 7. The two frame members 3,5 and linking frame member 7 form the support frame member. The linking frame member 7 has stubs 9 for vertical insertion into hooks 11 disposed on the two frame members 3,5. The linking frame member 7 may therefore be lifted up and out of engagement with the other two frame members 3,5 for disassembly of the log cutting apparatus 1. The linking frame member 7 is preferably elongated so that the first and second frame members 3,5 support a log to be cut at both ends of the log.

Figure 2A:
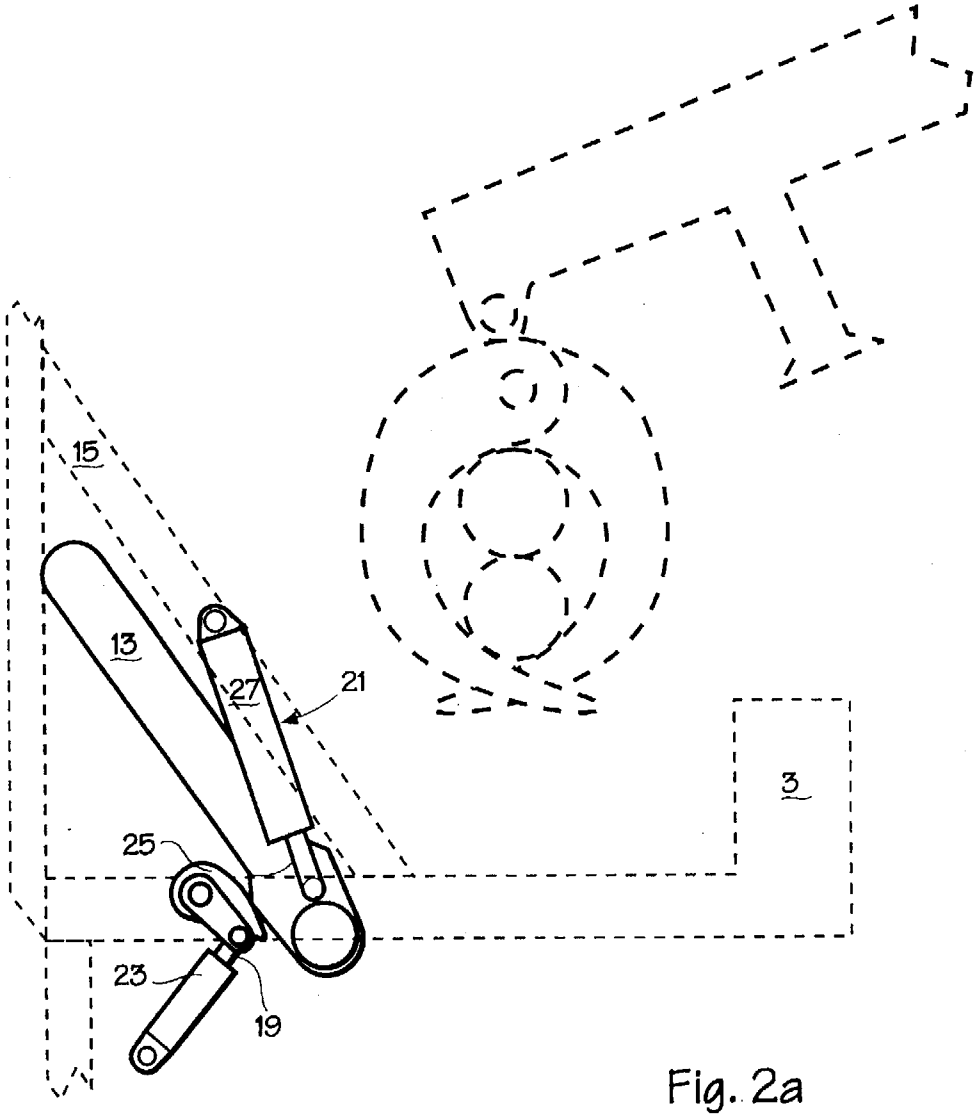
FIGS. 2*a–d* are schematic side views of the first frame member of the log cutting apparatus of FIG. 1.
Figure 2B:
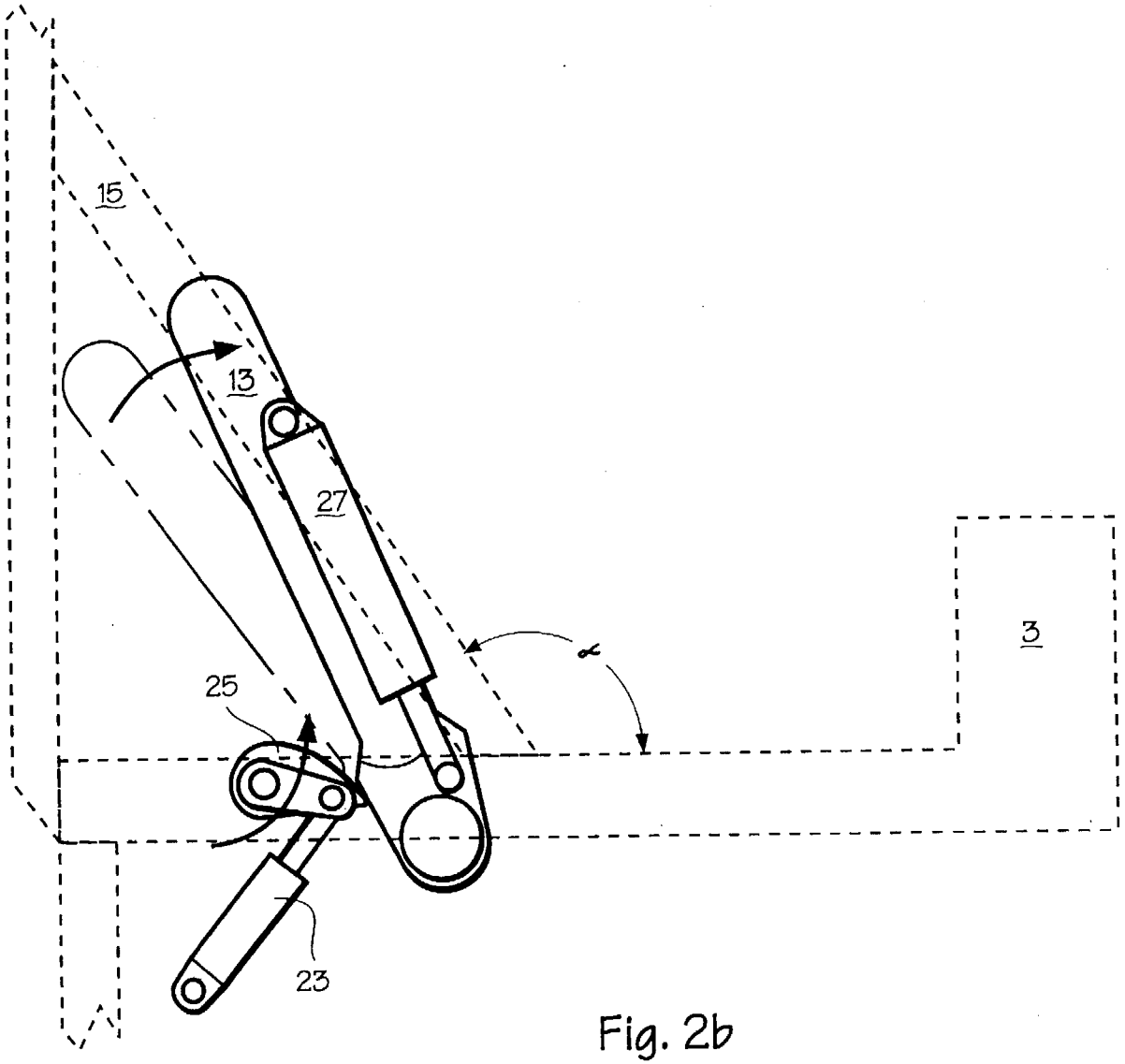
Figure 2C:
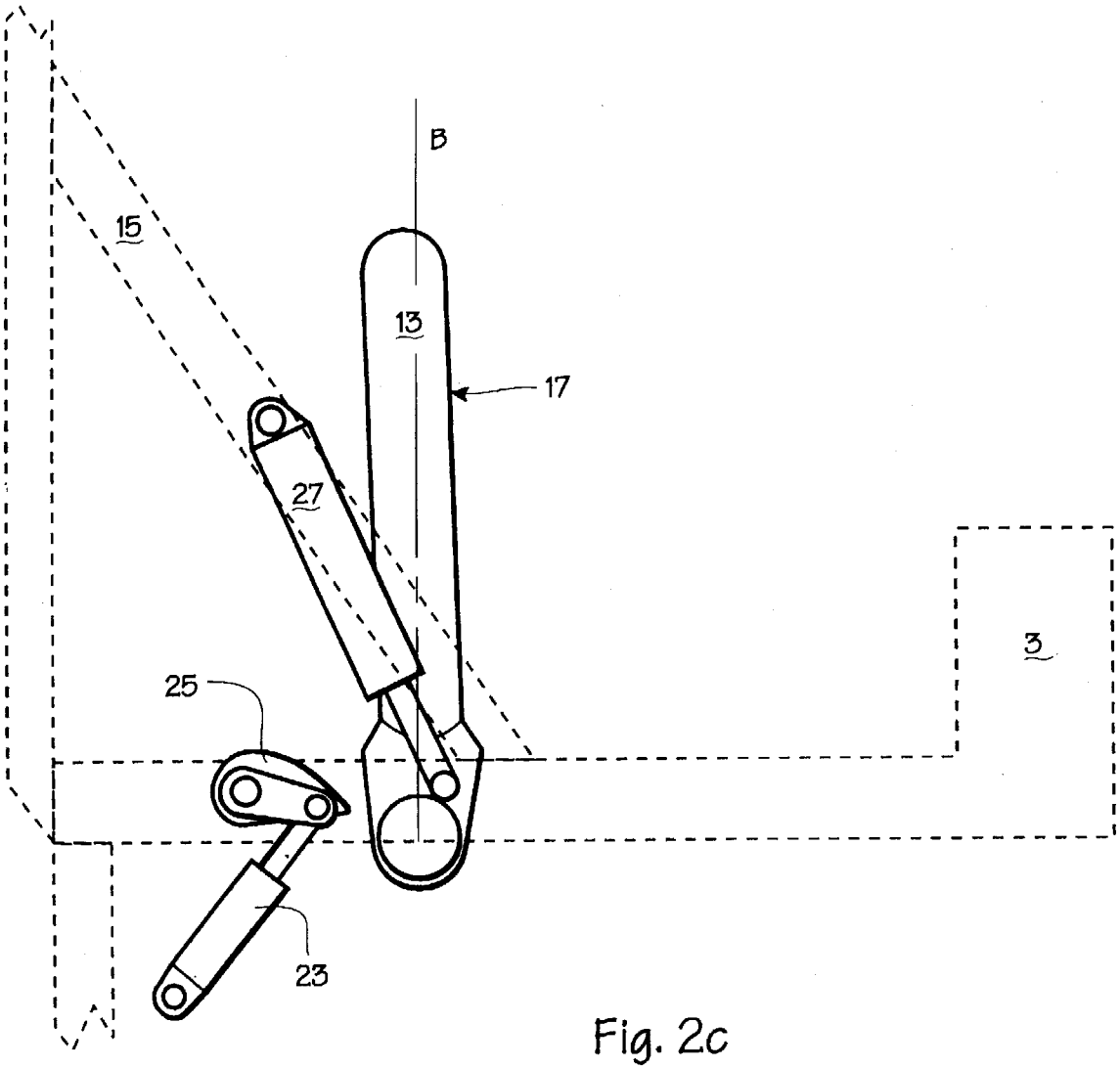

The log cutting arm 13 is located on the first frame member 3 preferably within a housing 15 of the first frame member 3 for protecting the cutting arm 13 during loading and unloading of logs. The cutting arm 13 is preferably a chainsaw bar with a chainsaw chain. As shown in FIG. 2*b*, one feature of the present invention is that the housing 15 and the portion of the first frame member 3, upon which logs are supported for cutting, form an obtuse angle $\alpha$, or in other words, the cutting arm 13 exhibits a reclined positioning when the cutting arm 13 is in the retracted position within the housing 15. Thus, the cutting side 17 Of the cutting arm 13 is disposed to face upwardly when the cutting arm 13 is in the retracted position. Furthermore, the cutting arm 13 passes through a vertical $\beta$ as shown in FIG. 2*c* when the cutting arm 13 moves between the retracted position of FIG. 3*a* and the extended position of FIG. 3*c*.

Figure 3A:
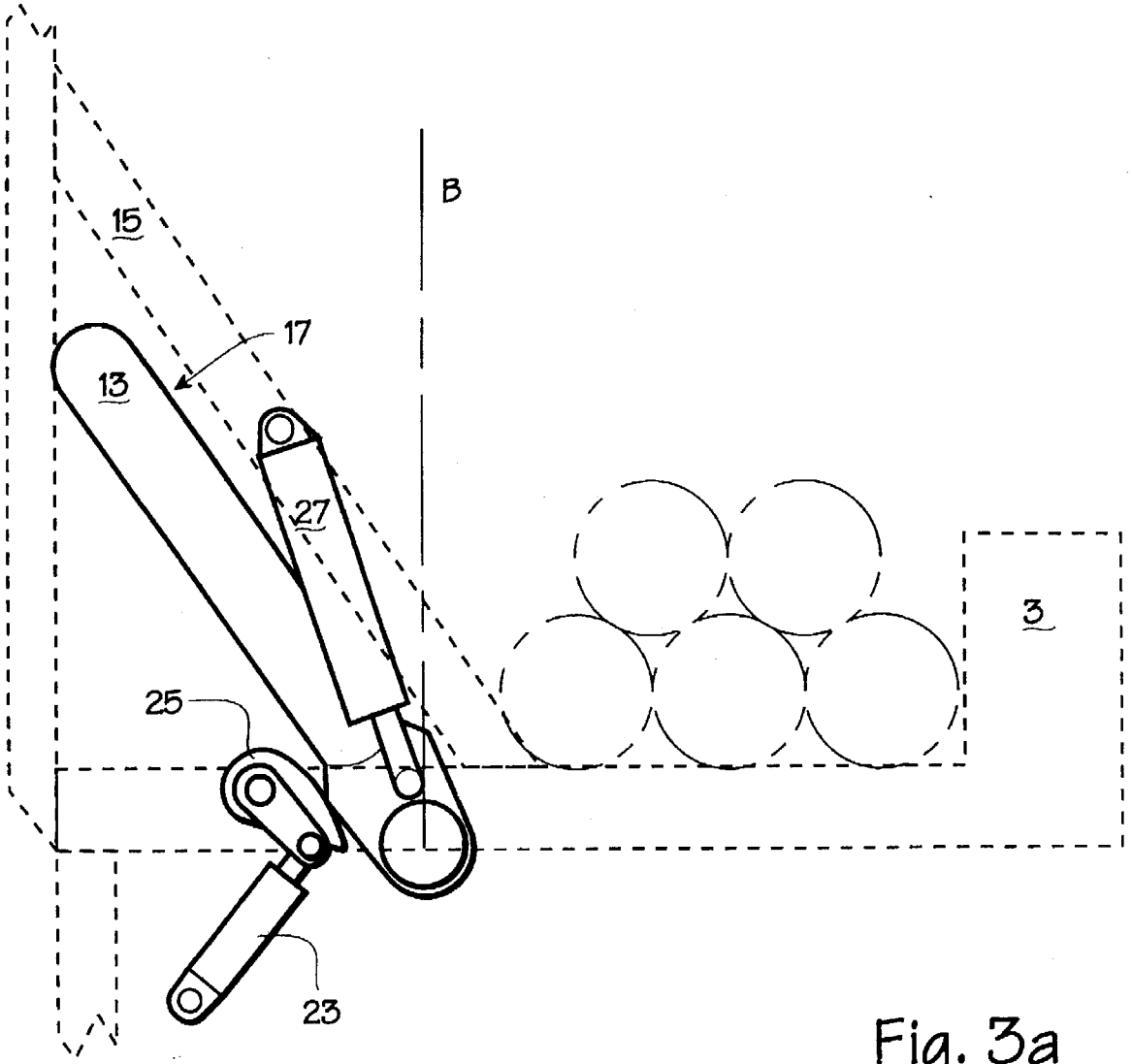
FIGS. 3*a–3c* are side schematic views of the first frame member of the log cutting apparatus of FIG. 1.
Figure 3B:
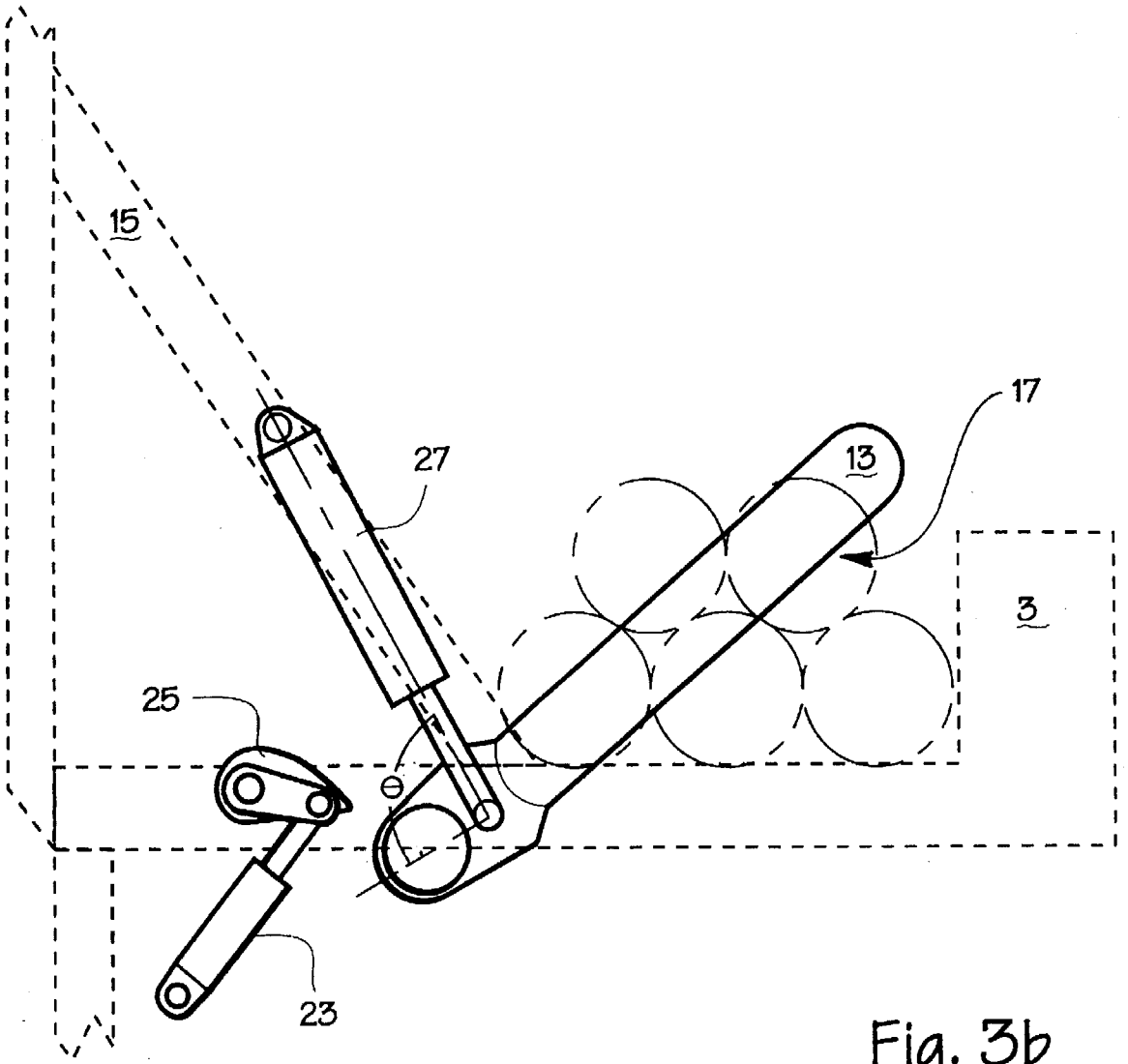
Figure 3C:
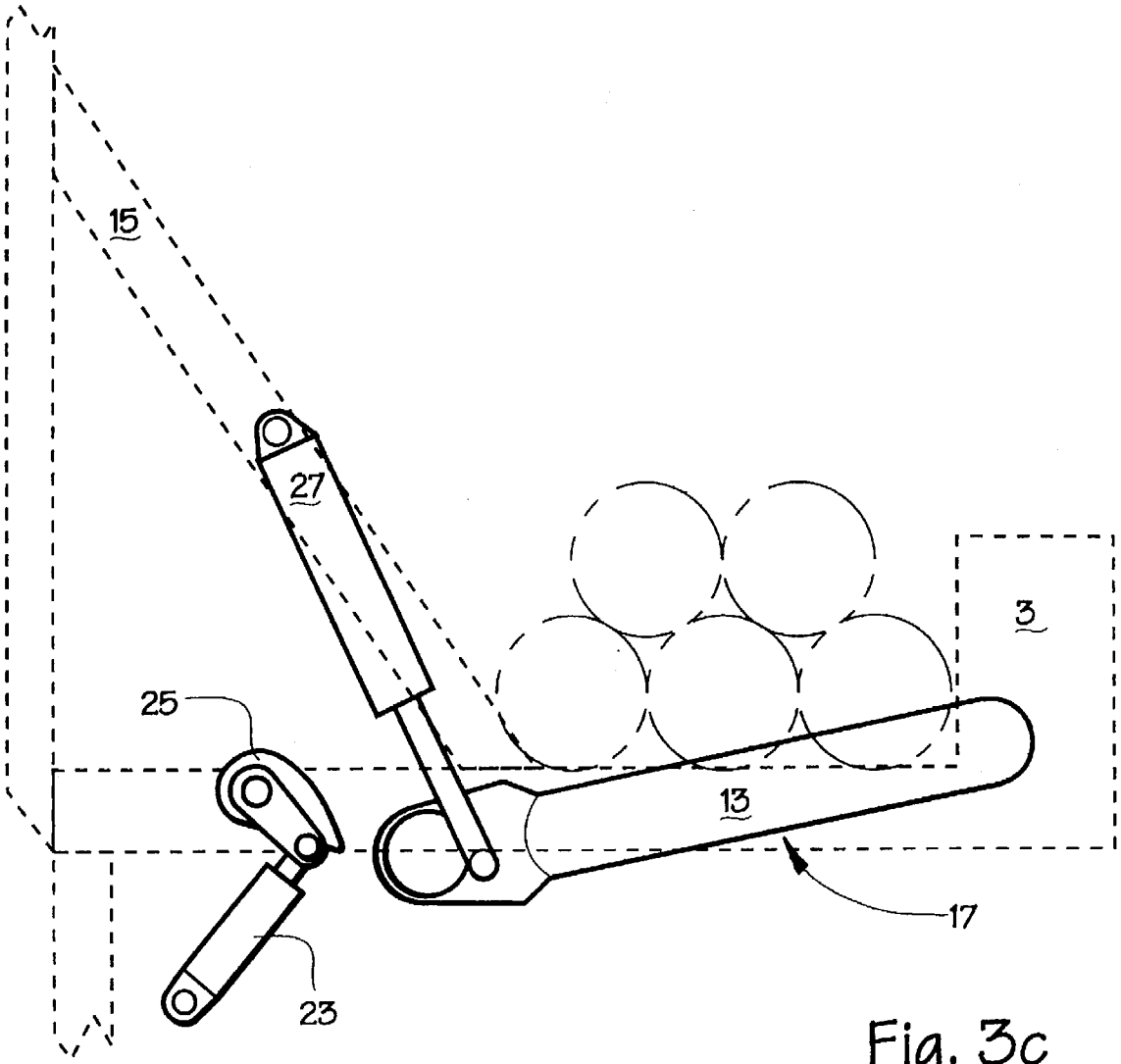
Figure 4:
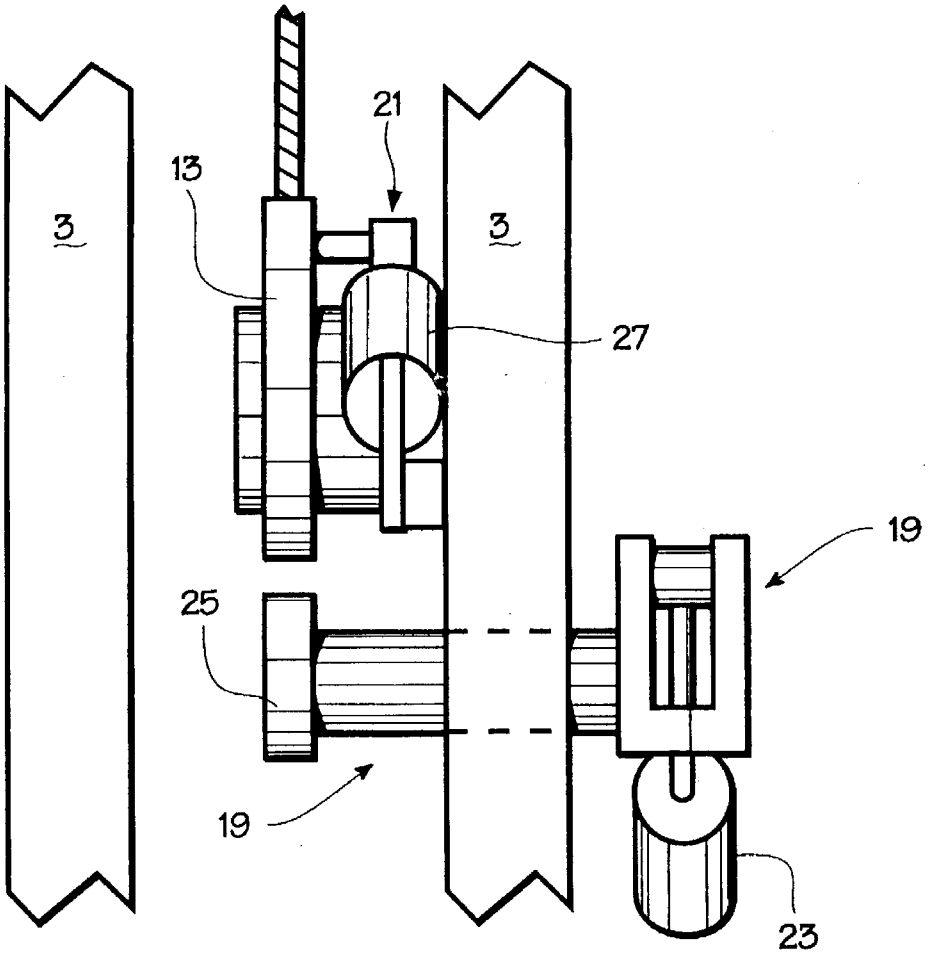
FIG. 4 is a top view of the first frame member, cutting arm, and hydraulic means of the log cutting apparatus of FIG. 1.

Another feature of the present invention is the combined use of two hydraulic means 19,21 for actuating the cutting stroke of the cutting arm 13. The first hydraulic means 19 comprises a first hydraulic cylinder 23 and a cam-link 25 as shown by FIG. 2*a*. When the cutting arm 13 is in the retracted position, the cam-link 25 engages the cutting arm 13. When the first hydraulic cylinder 23 expands, the cam-link 25 rotates to actuate the cutting arm 13 out of the retracted position to the intermediate position, as shown in FIG. 2*b*. During this actuation, the cam-link 25 disengages from the cutting arm 13, shown in FIG. 2*c*. The second hydraulic means 21 comprises a second hydraulic cylinder 27 which drives the cutting arm 13 through the cutting stroke from the intermediate position to the extended position, as shown in FIGS. 3*b* and 3*c*. The second hydraulic cylinder 27 is positioned between the cutting arm 13 and first frame member 3 such that during the midpoint of the actual cutting stroke, i.e., the midpoint between the intermediate position and the extended position, the second hydraulic cylinder 27 exerts a maximum torque upon the cutting arm 13 during actual log cutting. In other words, as shown in FIG. 3*b*, the angle $\theta$ formed by the second hydraulic cylinder 27 and the line segment connecting the pivot point of the cutting arm 13 with the point of attachment of the second hydraulic cylinder 27 with the cutting arm 13 is substantially a right angle at the midpoint of the actual cutting arc. Furthermore, it should be noted that to provide for this maximum torque at this point in the cutting arc in a log cutting apparatus having a laid back positioning of the cutting arm in the retracted position, the second hydraulic cylinder 27 should be substantially parallel aligned with the radius of the cutting arc as shown in FIG. 3*a*, thereby making the second hydraulic cylinder 27 ineffective in initiating pivotal movement of the cutting arm 13. Thus, the first hydraulic cylinder 23 is necessary in order to effectively move the cutting arm 13 from the retracted position to the intermediate position. The positioning of the first and second hydraulic means 19,21 with respect to the cutting arm 13 and first frame member 3 is shown in FIG. 4.

Figure 2D:
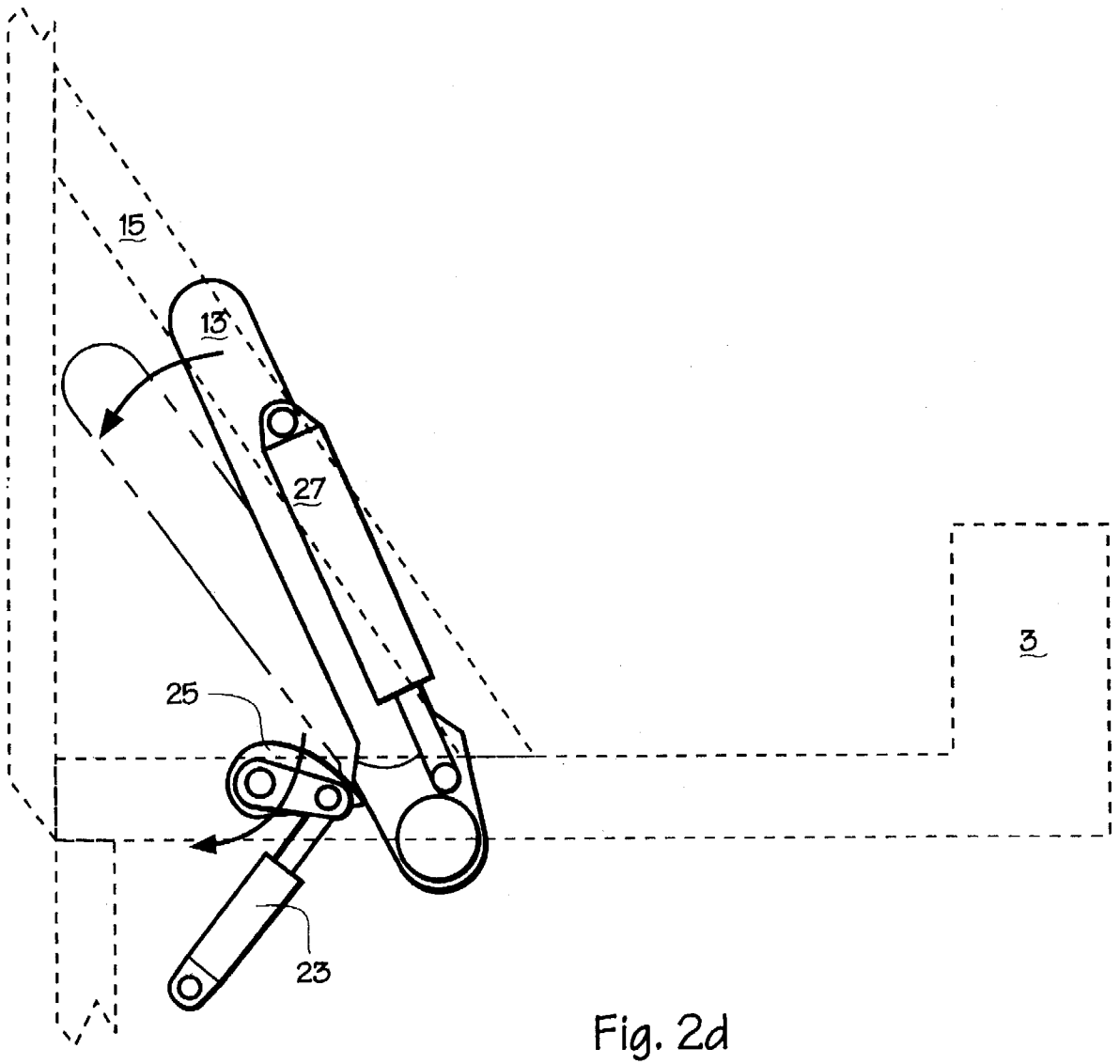

The first hydraulic means 19 is also advantageous in that it acts as a hydraulic retarder for the returning cutting arm 13 after a cutting stroke. The cutting arm 13 re-engages the cam-link 25 upon returning to the retracted position of FIG. 2*b* and forces compression of the first hydradiic cylinder 23, as shown in FIG. 2*d*. The compression of the first hydraulic cylinder 23 in turn reduces the angular velocity of the returning cutting arm 13. The first hydraulic means 19 also acts as a shock absorber when the cutting arm 13 reaches the retracted position.

Operation of the first hydraulic cylinder and cam-link is preferably conventionally controlled by the hydraulic fluid that powers the cutting chain of the cutting arm; it is parallel powered from the cutting chain motor power-in port without any special hydraulic valving or excess hydraulic plumbing. Thus, the first hydraulic cylinder and cam-link are actuated when the cutting arm chain is started.

As will be understood by one of the ordinary skill in the art, the present invention thus has numerous advantages. The first hydraulic means that assists in pivoting the cutting arm from the retracted position to the intermediate position allows a maximization of the effective cutting position of the cutting arm in the wood cutting throat area. The laid back positioning of the cutting arm within a protective housing increases the swing work area for a heel and knuckle boom that often is used to load logs onto the support frame to be cut by the cutting arm. The geometry also allows an increase in wood cutting throat area without increasing the width of the log support area of the support frame. Further, this geometry allows the log cutting apparatus to be placed closer to the base of a loader working with the log cutting apparatus for a more effective retracted boom-lifting geometry. Another advantage is that when the cutting arm approaches the retracted position, the first hydraulic means and the cam-link become a hydraulic retarder slowing the retracting cutting arm and acting as a shock absorber when the retracted position is reached.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A log cutting apparatus, comprising:

three separate support frame members removably attachable to form a support frame defining a log cutting area onto which a log is loaded for supporting therein the log to be cut, said three separate support frame members including a first support frame member defining said log cutting area for supporting therein a first end of the log to be cut, a second support frame member for supporting a second end of the log to be cut, and a linking support frame member removably attachable to both said first support frame member and said second support frame member for interlinking in fixed disposition said first support frame member to said second support frame member, means for removably attaching said linking support frame member to said first and said second support frame members for disassembly and transport of said support frame, a log cutting arm mounted to said support frame adjacent said log cutting area, and at least one hydraulic cylinder extending between said support frame and said cutting arm for actuating log cutting movement of said cutting arm.

2. A log cutting apparatus according to claim 1, wherein said cutting arm is pivotally mounted to said support flame for pivotal log cutting movement and said cutting arm passes through a vertical position during said pivotal movement of said cutting arm.

3. A log cutting apparatus according to claim 1, wherein said cutting arm is pivotally mounted to said support frame for pivotal log cutting movement, and wherein said at least one hydraulic cylinder comprises a first hydraulic cylinder pivotally connected to said support frame and extending between said support frame and said cutting arm for actuating pivotal movement of said cutting arm from a retracted position to an intermediate position, and a second hydraulic cylinder pivotally connected to said support frame and to said cutting arm for actuating pivotal movement of said cutting arm from said intermediate position to an extended position.

4. A log cutting apparatus according to claim 1, further comprising a cam-link, wherein said cutting arm is pivotally mounted to said support frame for pivotal log cutting movement, said at least one hydraulic cylinder comprises s comprises a first hydraulic cylinder pivotally attached to said support frame at one end thereof and pivotally attached to said cam-link at the other end thereof, said cam-link being pivotally attached to said support frame, and said cam-link engages said cutting arm when said cutting arm is in a retracted position and urges said cutting arm out of said retracted position to an intermediate position when said first hydraulic cylinder rotates said cam-link.

5. A log cutting apparatus according to claim 4, wherein said cam-link disengages from said cutting arm when said cutting arm rotates towards said extended position and wherein said cam-link reengages said cutting arm when said cutting arm rotates back towards said retracted position, said cam-link and said first hydraulic cylinder becoming a hydraulic retarder slowing said cutting arm and acting as a shock absorber when said cutting arm reaches said retracted position.

6. A log cutting apparatus, comprising:

a support frame defining a log cutting area onto which a log is loaded for supporting therein the log to be cut, a log cutting arm pivotally mounted in fixed disposition to said support frame adjacent said log cutting area for log cutting movement between a retracted position and an extended position, a first hydraulic cylinder mounted to said support frame and extending between said support frame and said cutting arm for actuating movement of said cutting arm from said retracted position to an intermediate position, and a second hydraulic cylinder mounted to said support frame and to said cutting arm for actuating movement of said cutting arm from said intermediate position to said extended position.

7. A log cutting apparatus according to claim 6, wherein said support frame comprises three separate support frame members removably attachable to form said support frame including a first support frame member defining said log cutting area for supporting therein a first end of the log to be cut, a second support frame member for supporting a second end of the log to be cut, and a linking support frame member removably attachable to said first support frame member and to said second support frame member for interlinking in fixed disposition said first support frame member and said second support frame member.

8. A log cutting apparatus according to claim 6, further comprising a cam-link, wherein said first hydraulic cylinder is pivotally attached to said support frame at one end thereof and pivotally attached to said cam-link at the other end thereof, said cam-link is pivotally attached to said support frame, and said cam-link engages said cutting arm when said cutting arm is in said retracted position and urges said cutting arm out of said retracted position to said intermediate position when said first hydraulic cylinder rotates said cam-link.

9. A log cutting apparatus according to claim 8, wherein said cam-link disengages from said cutting arm when said cutting arm rotates towards said extended position and wherein said cam-link reengages said cutting arm when said cutting arm rotates back towards said retracted position, said cam-link and said first hydraulic cylinder becoming a hydraulic retarder slowing said cutting arm and acting as a shock absorber when said cutting arm reaches said retracted position.

10. A log cutting apparatus, comprising:

a support frame defining a log cutting area having a log support surface onto which a log is loaded for supporting the log to be cut, said support frame including a housing that forms an obtuse angle with said support surface, an elongated log cutting arm pivotally mounted in fixed disposition to said support frame within said housing adjacent said log cutting area for pivotal log cutting movement through a log cutting stroke between a retracted position whereat said log cutting arm is disposed entirely within said housing, and an extended position whereat said log cutting arm extends outside of said housing, a cutting side of said log cutting arm passing substantially fully through said cutting area in moving from said retracted position to said extended position, a first hydraulic cylinder extending between said support frame and said cutting arm for actuating pivotal movement of said cutting arm from said retracted position to an intermediate position, and a second hydraulic cylinder extending between said support frame and said cutting arm for actuating pivotal movement of said cutting arm from said intermediate position to said extended position.

11. A log cutting apparatus according to claim 10, wherein said first hydraulic cylinder is pivotally mounted to said support frame and said second hydraulic cylinder is pivotally mounted to said support frame and said cutting arm.

12. A log cutting apparatus according to claim 11, further comprising a cam-link, wherein said first hydraulic cylinder is pivotally attached to said support frame at one end thereof and pivotally attached to said cam-link at the other end thereof, said cam-link is pivotally attached to said support frame, and said cam-link engages said cutting arm when said cutting arm is in said retracted position and urges said cutting arm out of said retracted position to said intermediate position when said first hydraulic cylinder rotates said cam-link.

13. A log cutting apparatus according to claim 12, wherein said cam-link disengages from said cutting arm when said cutting arm rotates towards said extended position and wherein said cam-link reengages said cutting arm when said cutting arm rotates back towards said retracted position, said cam-link and said first hydraulic cylinder becoming a hydraulic retarder slowing said cutting arm and acting as a shock absorber when said cutting arm reaches said retracted position.

14. A tree cutting apparatus, comprising:

a frame defining a cutting area for receiving therein a tree to be cut, an elongated cutting arm pivotally mounted to said frame adjacent said cutting area for pivotal cutting movement between a retracted position and an extended position, a first hydraulic cylinder and a cam-link, said first hydraulic cylinder being pivotally attached to said frame at one end thereof and pivotally attached to said cam-link at the other end thereof, said cam-link being pivotally attached to said support frame with said cam-link engaging said cutting arm when said cutting arm is in said retracted position and urging said cutting arm out of said retracted position to an intermediate position when said first hydraulic cylinder rotates said cam-link, and a second hydraulic cylinder extending between said frame and said cutting arm for actuating pivotal movement of said cutting arm from said intermediate position to said extended position.

15. An apparatus according to claim 14, wherein said cam-link disengages from said cutting arm when said cutting arm rotates towards said extended position and wherein said cam-link reengages said cutting arm when said cutting arm rotates back towards said retracted position, said cam-link and said first hydraulic cylinder becoming a hydraulic retarder slowing said cutting arm and acting as a shock absorber when said cutting arm reaches said retracted position.

16. A log cutting apparatus, comprising:

three separate support frame members removably attachable to form a support frame, including a first support frame member defining a log cutting area for supporting therein a first end of a log to be cut, a second support frame member for supporting thereon a second end of the log to be cut, and an elongate linking support frame member, said first and second support frame members having hooks and said linking support frame member having stubs, said stubs being insertable into said hooks for interlocking said first and said second support frame members in fixed disposition by said linking support frame member, a log cutting arm mounted to said support frame adjacent said log cutting area for log cutting movement of said cutting arm, and at least one hydraulic cylinder extending between said support frame and said cutting arm for actuating cutting movement of said log cutting arm.

17. A log cutting apparatus according to claim 16, wherein said cutting arm is pivotally mounted to said support frame and said at least one hydraulic cylinder includes a first hydraulic cylinder pivotally mounted to said support frame and extending between said support frame and said cutting arm for actuating pivotal movement of said log cutting arm from a retracted position to an intermediate position, and a second hydraulic cylinder pivotally mounted to said support frame and to said cutting arm for actuating pivotal movement of said cutting arm from said intermediate position to said extended position.

18. A log cutting apparatus according to claim 17, further comprising a cam-link, wherein said first hydraulic cylinder is pivotally attached to said support frame at one end thereof and pivotally attached to said cam-link at the other end thereof, said cam-link is pivotally attached to said support frame, and said cam-link engages said cutting arm when said cutting arm is in said retracted position and urges said cutting arm out of said retracted position to said intermediate position when said first hydraulic cylinder rotates said cam-link.

19. A log cutting apparatus according to claim 18, wherein said cam-link disengages from said cutting arm when said cutting arm rotates towards said extended position and wherein said cam-link reengages said cutting arm when said cutting arm rotates back towards said retracted position, said cam-link and said first hydraulic cylinder becoming a hydraulic retarder slowing said cutting arm and acting as a shock absorber when said cutting arm reaches said retracted position.

* * * * *